US008499809B2

(12) United States Patent
Kleinegger et al.

(10) Patent No.: US 8,499,809 B2
(45) Date of Patent: Aug. 6, 2013

(54) TAPE DISPENSER AND TAKE-UP REEL FOR TAPE BACKING

(75) Inventors: Herbert Kleinegger, Bristol, CT (US); James M Ferro, Shelton, CT (US)

(73) Assignee: The Midsun Group, Southington, CT (US)

( * ) Notice: Subject to any disclaimer, the term of this patent is extended or adjusted under 35 U.S.C. 154(b) by 246 days.

(21) Appl. No.: 13/098,841

(22) Filed: May 2, 2011

(65) Prior Publication Data

US 2011/0265955 A1 Nov. 3, 2011

Related U.S. Application Data

(60) Provisional application No. 61/330,694, filed on May 3, 2010.

(51) Int. Cl.
*B65D 85/02* (2006.01)
*B65H 35/07* (2006.01)

(52) U.S. Cl.
USPC ..... 156/527; 156/574; 156/577

(58) Field of Classification Search
USPC ..... 156/574, 577, 526, 527
See application file for complete search history.

(56) References Cited

U.S. PATENT DOCUMENTS

| | | | | |
|---|---|---|---|---|
| 4,648,935 | A * | 3/1987 | Brown et al. | 156/577 |
| 4,804,437 | A * | 2/1989 | Tirtoprodjo et al. | 156/577 |
| 6,363,990 | B1 * | 4/2002 | Kozaki | 156/540 |
| 6,418,997 | B1 * | 7/2002 | Tamai et al. | 156/577 |
| 6,453,968 | B1 * | 9/2002 | Hsu | 156/577 |
| 6,568,450 | B1 * | 5/2003 | Stevens | 156/540 |
| 7,610,665 | B2 * | 11/2009 | Casaldi et al. | 29/428 |
| 2005/0072529 | A1 * | 4/2005 | Yonezawa et al. | 156/540 |

FOREIGN PATENT DOCUMENTS

JP 06127774 A * 5/1994

* cited by examiner

*Primary Examiner* — Mark A Osele
(74) *Attorney, Agent, or Firm* — Joseph R. Carvalko

(57) ABSTRACT

This invention generally relates to a tape dispenser with automatic backing removal more particularly suited for tape and an associated backing, employing a frame and affixed thereto a tape supply spindle rotatably mounted for receiving a roll of tape; said tape supply spindle having thereon a friction disc for pressing against a rotating take-up spindle mounted to said frame and to receive the protective tape backing when the take-up spindle rotates upon an application of a pulling force to the tape.

5 Claims, 3 Drawing Sheets

TAPE DISPENSER AND TAKE-UP REEL FOR TAPE BACKING

CROSS-REFERENCE TO RELATED APPLICATIONS

This application claims the priority benefit under 35 U.S.C. 119 (e) of U.S. Provisional Application No. 61/330,694, Tape Dispenser and Take-up Reel for Associated Tape Backing filed on May 3, 2010, the entire disclosure of which is hereby incorporated by reference herein.

FIELD OF THE INVENTION

This invention relates to dispensers for tape with backing requiring removal.

BACKGROUND OF THE INVENTION

A tape dispenser is a device that holds a roll of tape and has a mechanism on one end to cut or shear-off the tape. Dispensers vary widely based on the tape they dispense. Abundant and most common, clear tape dispensers are commonly made of plastic, and may be disposable. Other dispensers are stationary and may have sophisticated features to control tape usage and improve ergonomics. Tape dispensers for silicon tapes with Mylar (Mylar® registered trademark of DuPont Teijin Films) protective backing that separates tape layers are wound on a tape spool and require more complex tape dispensing mechanisms to allow dispensing while stripping-off the backing. Without an auto mechanism the process of removing the backing material is time consuming and wasteful, since in trying to remove the backing, strips of tape can damage the useful part of the tape, especially when lifting the backing with a fingernail or pointed tool to separate the layers. Manual methods for removing backing takes time and resources that can account for a significant dollar value in any project. The manual removal method also requires the use of both hands. Thus, the user has to stop a job, put down tools, and often remove work gloves to separate the backing. Adverse weather conditions make this all the more difficult.

SUMMARY OF THE INVENTION

This invention generally relates to a dispensing apparatus for tape with protective backing, including: a housing and affixed thereto a tape supply spindle rotatably mounted for receiving a roll of tape; said tape supply spindle having thereon a friction carrying device for applying frictional pressure to a backing or rotatable take-up spindle mounted to said frame and to receive said protective tape backing when the rotatable take-up spindle rotates upon an application of a pulling force to the supply tape.

In one embodiment the frictional device is provided for, by way of example, a rubber "O" ring that when installed in a pulley affixed to the take-up spindle, passed in contact with a tension roller and installed in a pulley affixed to the tape supply spindle interengages the rotatable take-up spindle and turns the take-up spindle when the tape supply spindle turns. When the tape supply spindle is pulled by a user removing the tape from the dispenser, the "O" ring on the tape supply spindle rotates and in turn rotates the take-up spindle. In an alternate embodiment the invention includes the friction carrying device directly contacts a rotatable take-up spindle.

The tape supply spindle further includes a tape spindle assembly fixedly attached to a top housing structure and to an inner housing surface.

In one embodiment the dispensing apparatus further includes a cut off device having serrated teeth. The teeth are within and set below two outer limits to provide safety from cutting into a user's fingers. In another embodiment, the dispensing apparatus further includes a cut off device having a blade within a rotatable blade-holder.

The invention disclose herein is also a method for dispensing a tape with a protective backing, including the steps of: inserting the roll of tape into housing having tape supply spindle for rotatably receiving said roll of tape; separating a portion of the tape from the protective backing; threading said separated portion of the tape into dispensing channel; threading portion of the separated protective backing onto rotatable take-up spindle; pulling said tape separated portion of the tape through the dispensing channel, whereby the rotatable take-up spindle having associated thereon a friction carrying device for receiving frictional pressure from tape supply spindle, winds said protective tape backing on the rotatable take-up spindle when the tape spindle rotates upon an application of the pulling force to the tape.

DETAILED DESCRIPTION OF THE INVENTION

Figure 1:
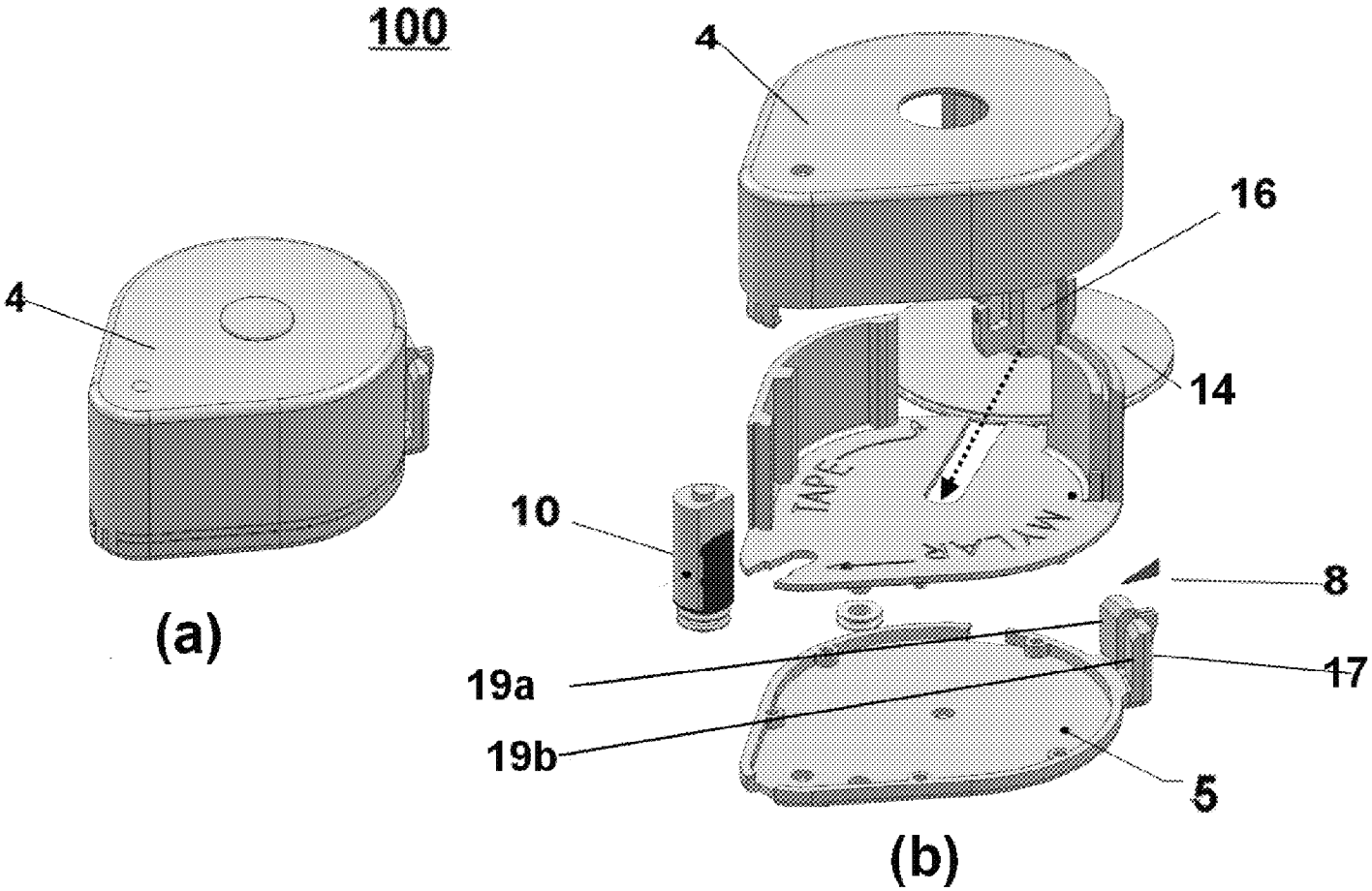
FIG. 1 (*a, b*) is a perspective view and an illustrated parts breakdown showing the relative positioning of parts for a tape dispensing mechanism in accordance with an embodiment of the invention.

The following detailed description includes the best mode of carrying out the invention and is made for the purpose of illustrating the general principles of the invention and should not be taken in a limiting sense. The scope of the invention is determined by reference to the claims. Each part or function is assigned, even if structurally identical to another part, a unique reference number wherever that part is shown in the drawing figures.

Referring to FIG. 1*a*, the invention disclosed herein relates to compact dispensing apparatus 100 for dispensing tape 3, as by way of example and not limitation, silicone tape with protective backing 6 such as Mylar. FIG. 1*b* illustrates the major components of the apparatus 100, including: a top housing, 4, and bottom housing 5, and affixed there-between a tape supply spindle 16 rotatably mounted for receiving a roll of tape 3; said tape supply spindle 16 having thereon a rotatable disc 14 for contacting and creating a friction which rotates a rotatable take-up spindle 10 mounted to the bottom housing 5, to receive the protective tape backing 6. A cutting mechanism 8, having in one embodiment, serrated teeth, and in another embodiment, a blade, cuts the tape when dispensing for its intended application.

Figure 2:
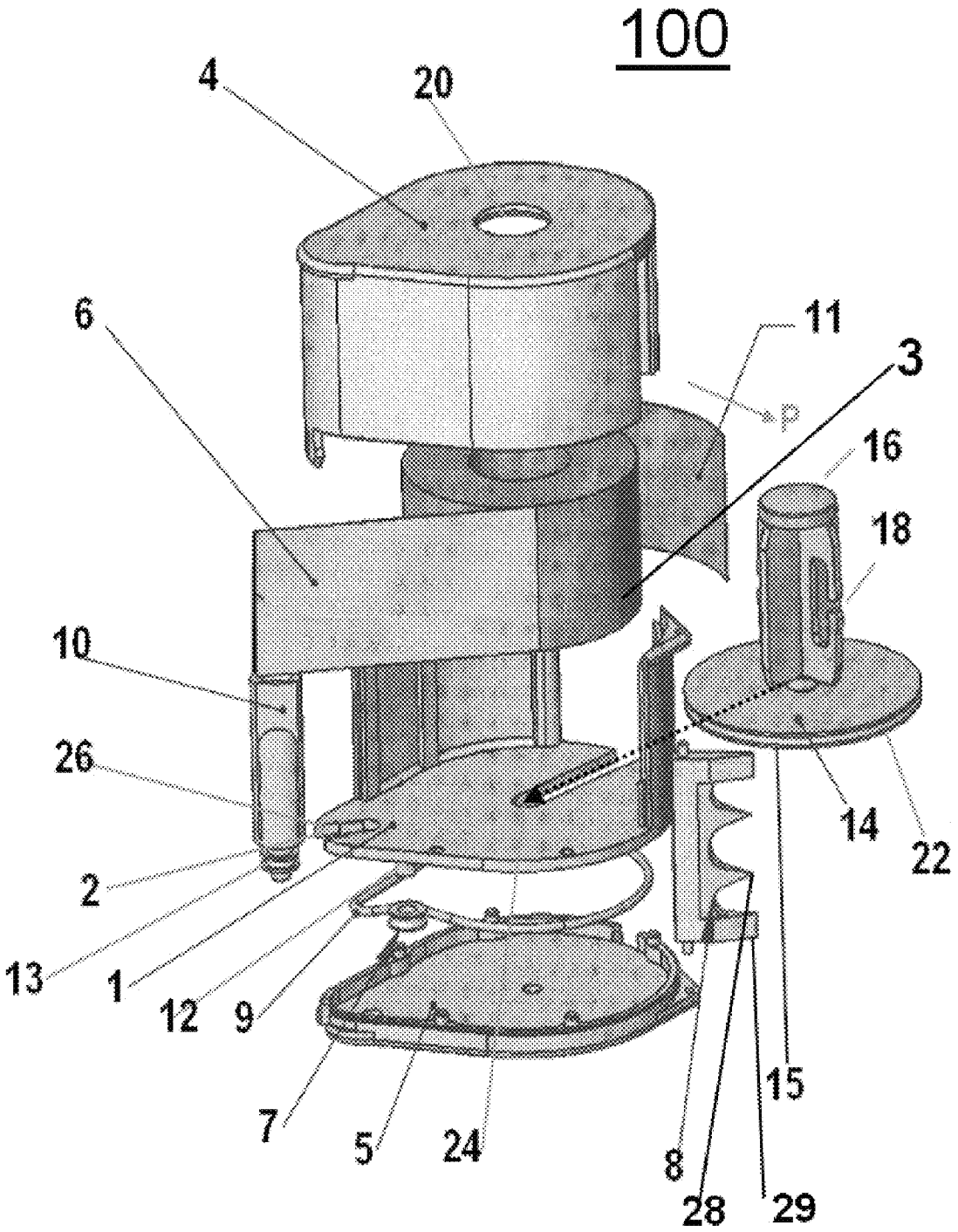
FIG. 2 is an illustrated parts breakdown showing the relative positioning of parts for a tape dispensing mechanism in accordance with an embodiment of the invention.

FIG. 2 illustrates an embodiment of the invention in greater detail. Upon an application of a pulling force P to roll of tape 3, such as by way of example, silicone tape, the rotatable take-up spindle 10 rotates winding the backing tape 6 into a roll. In one embodiment the device for creating the friction, mentioned above, may be a friction wheel, such as rotatable disc 14 that directly contacts rotatable spindle 10. In another embodiment the frictional device such as a rubber "O" ring 9 interengages the disc 14 pulley recess 15, a tension roller 7 and the spindle 10, pulley 13. The tension roller 7 mounts on a stud or boss 12.

The tape supply spindle 16 assembly includes a tape holder comprised of the supply spindle 16, which has at least one compression member 18 for securing the roll of silicon tape 3 with the backing 6 to the supply spindle 16. The tape holder assemble is captured for rotation by in through-hole 20 at the top housing 4. The tape supply spindle 16 assembly slides into the slot 24 and the friction disc 14 is thereby situated on the under-side of the bottom of surface plate 1. The spindle 10 slides into the slot 26 and is thereby captured in the surface plate 1.

The friction disc 14 fixedly attaches to the supply spindle 16 and has a circumference that contacts the spindle 10 and presents a frictional surface when they are engaged or when an intermediate device is employed such as a belt, band, or gears. The frictional surface may be achieved using an "O" ring. In one embodiment the disc 14 has the recess 15 forming pulley 22 into which rubber "O" ring 9 or a specially designed grommet serves to create the necessary frictional device that interengages with tension roller 7 and the spindle 10 pulley 13. The tension roller 7 supplies a small amount of drag on the "O" ring 9. In an alternate embodiment, the friction may be manufactured into the disc 14 as a composition of rubber or other available moldable product, where it then directly contacts the spindle 10, which also may be manufactured into the spindle 10 as a composition of rubber or other suitable moldable product. In yet another embodiment the tape supply spindle 16 for receiving a roll of tape 3 further includes a spur gear to engage a second spur gear affixed to the take-up spindle. In this embodiment, the disc 14 takes the form of a spur gear and the spindle 10 pulley 13 is replaced by a spur gear, whereby the two gears are engaged to achieve the rotation of the spindle 10 as the tape is pulled for dispensing.

In the preferred embodiment, all parts except for the "O" ring are made of plastic to provide a cost effective and sturdy dispenser. Other materials and dimensions are within the scope of the invention.

Figure 3:
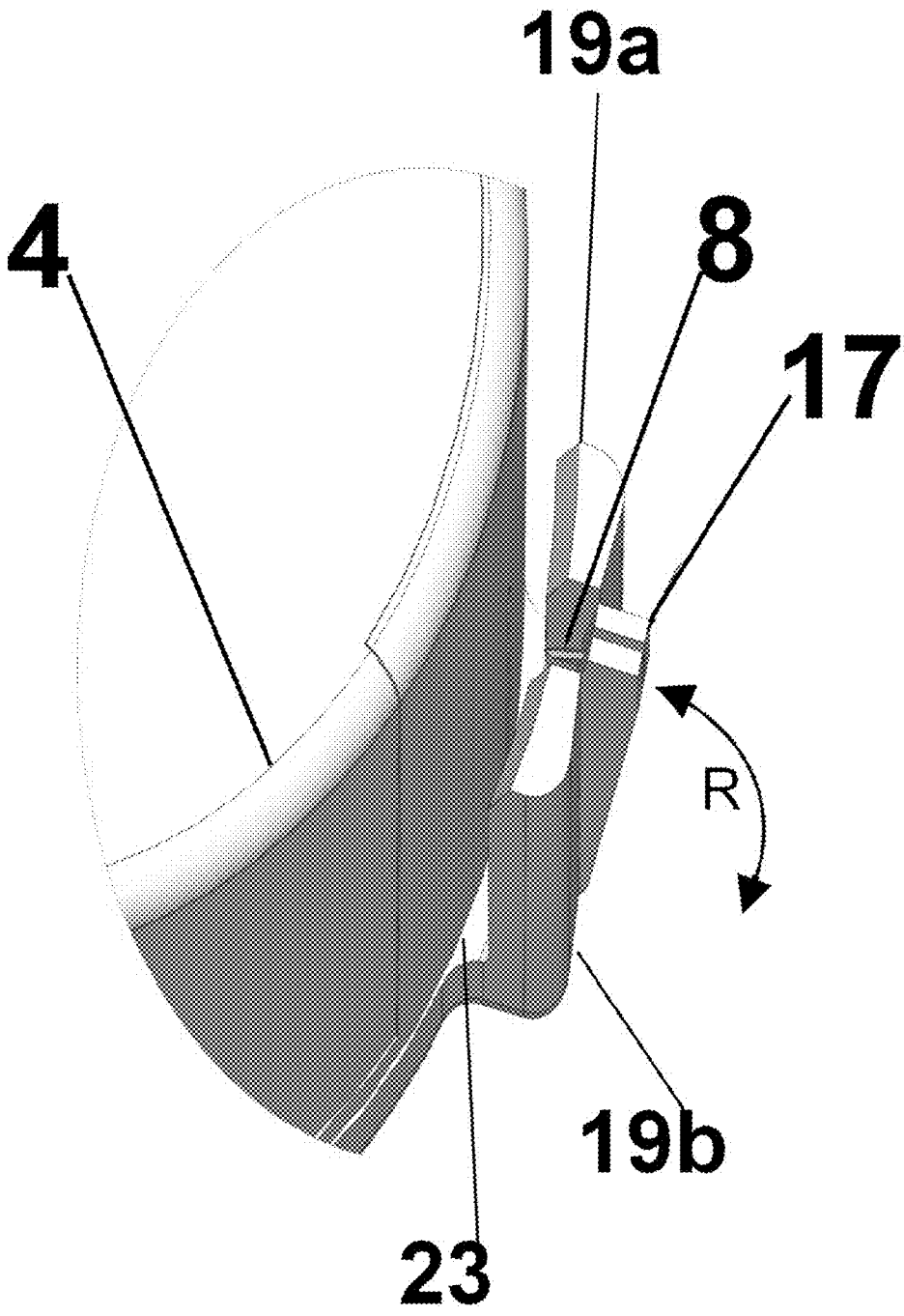
FIG. 3 is a perspective view of the tape cutting mechanism in accordance with an embodiment of the invention.

Returning to FIG. 2, the tape dispensing apparatus 100 further includes a non limiting embodiment of a cut-off device 8 having serrated teeth 28. The teeth are within and set below the outer frame limit 29 to provide safety from cutting into a user's fingers. As shown in FIG. 3, the tape dispensing apparatus 100 further includes a preferred non limiting embodiment of a cut off blade 8 (also, see FIG. 1) attached to lever-action member 17 which acts between two members 19*a*, 19*b*, to cut off the tape passing through the containment channel 23.

A method for dispensing a tape with a protective backing, including the steps of: inserting the roll of tape 3 into housing 4 having tape supply spindle 16 for rotatably receiving said roll of tape 3; separating a portion 11 of the tape 3 from the protective backing 6; threading said separated portion 3 of the tape into dispensing channel 23; threading portion of the separated protective backing 4 onto rotatable take-up spindle 10; pulling P said tape separated portion 11 of the tape 3 through the dispensing channel 23, whereby the rotatable take-up spindle 10 having associated thereon a friction carrying device for receiving frictional pressure from tape supply spindle, winds said protective tape backing 6 on the rotatable take-up spindle 10 when the tape supply spindle rotates 16 upon an application of the pulling force P to the tape 3.

While the foregoing invention has been described with reference to the above embodiments, additional modifications and changes can be made without departing from the spirit of the invention. Accordingly, such modifications and changes are considered to be within the scope of the appended claims.

We claim:

1. A dispensing apparatus for tape with a protective backing, comprising: a tape supply spindle rotatably mounted for receiving a roll of tape; said tape supply spindle having thereon a device for applying pressure to a rotatable take-up spindle mounted to receive said protective tape backing when the rotatable take-up spindle rotates upon an application of a pulling force to the tape; wherein the device for applying pressure is a friction carrying device comprised of a rubber "O" ring that interengages the rotatable pulley recess, a tension roller and the rotatable take-up spindle pulley; and wherein the tape supply spindle mounted for receiving a roll of tape further includes at least one compression member for securing the roll of tape with backing to the rotatable take-up spindle; and wherein the tape supply spindle and the friction carrying device slides into a slot and is thereby captured beneath the lower bottom of a surface plate.

2. The dispensing apparatus for tape in claim 1, wherein the friction carrying device fixedly attaches to the supply spindle and has a circumference that presents a frictional surface to the rotational take-up spindle when they are engaged or when an intermediate device is employed.

3. The dispensing apparatus for tape in claim 1, wherein the tape supply spindle mounted for receiving a roll of tape further includes a spur gear to engage a second spur gear affixed to the take-up spindle.

4. The dispensing apparatus for tape in claim 1, includes a tape cut-off device having serrated teeth.

5. The dispensing apparatus for tape in claim 1, includes a cut-off blade attached to lever-action member.

* * * * *